US008276644B2

(12) United States Patent
Akaneya

(10) Patent No.: US 8,276,644 B2
(45) Date of Patent: Oct. 2, 2012

(54) MOLD AND CASTING METHOD USING THE MOLD AND DESIGN METHOD OF THE MOLD

(75) Inventor: Muneaki Akaneya, Nagoya (JP)

(73) Assignee: Aisin Aw Co., Ltd., Anjo (JP)

( * ) Notice: Subject to any disclaimer, the term of this patent is extended or adjusted under 35 U.S.C. 154(b) by 0 days.

(21) Appl. No.: 13/296,757

(22) Filed: Nov. 15, 2011

(65) Prior Publication Data

US 2012/0152478 A1 Jun. 21, 2012

(30) Foreign Application Priority Data

Dec. 20, 2010 (JP) ..... 2010-283179

(51) Int. Cl.
*B22C 9/08* (2006.01)

(52) U.S. Cl. ..... 164/113; 164/312; 164/359

(58) Field of Classification Search ..... 164/113, 164/359, 312–318
See application file for complete search history.

(56) References Cited

U.S. PATENT DOCUMENTS 6,619,370 B2 * 9/2003 Sakamoto et al. ..... 164/113
2009/0165982 A1 7/2009 Kanno et al.

FOREIGN PATENT DOCUMENTS

JP A-2002-346728 12/2002
JP 2009-136902 A 6/2009
JP 2009-248119 A 10/2009
WO WO 2006/117837 A1 11/2006

OTHER PUBLICATIONS

Feb. 21, 2012 International Search Report issued in PCT/JP2011/077744 (with translation).

* cited by examiner

*Primary Examiner* — Jessica L Ward
*Assistant Examiner* — Kevin E Yoon
(74) *Attorney, Agent, or Firm* — Oliff & Berridge, PLC

(57) ABSTRACT

A mold including a product cavity that is to be filled with a molten metal to mold a product; a supply cavity that connects to one side of the product cavity to supply the product cavity with the molten metal that is poured from a casting port; and a cooling cavity that connects to the other side of the product cavity and in which the molten metal filling the cooling cavity is cooled before the molten metal filling the product cavity and the supply cavity is cooled. A modulus M (=V/S) as a ratio of a volume V to a cooling surface area S in each of the cavities has a relation of Ms>Mp>Mc, where Mp is a modulus of the product cavity, Ms is a modulus of the supply cavity, and Mc is a modulus of the cooling cavity.

8 Claims, 6 Drawing Sheets

MOLD AND CASTING METHOD USING THE MOLD AND DESIGN METHOD OF THE MOLD

INCORPORATION BY REFERENCE

The disclosure of Japanese Patent Application No. 2010-283179 filed on Dec. 20, 2010 including the specification, drawings and abstract is incorporated herein by reference in its entirety.

BACKGROUND OF THE INVENTION

The present invention relates to a mold that is to be filled with a molten metal to mold a cast product and casting methods using the mold, and design methods of the mold

DESCRIPTION OF THE RELATED ART

When performing casting such as die casting, various measures have been taken to prevent formation of blow holes (deformation such as voids, cracks, or shrinkage, which occurs in molded articles) during solidification and shrinkage of a molten metal. For example, in product designs, measures have been taken such as measures to make the thickness of each part of a product uniform, to eliminate thick portions in a product, or the like, and measures to provide a cooling hole in a mold to perform cooling or the like.

For example, in a casting method and a casting apparatus of Japanese Patent Application Publication No. JP-A-2002-346728, it is disclosed that a molten metal is poured into a die, and is directionally solidified from one side to the other side by heating/cooling means after a surface layer of the molten metal in contact with the die is solidified. In a part having a complex shape, satisfactory directional solidification is caused to proceed based on the result of flow and solidification simulation to prevent generation of casting defects, thereby implementing manufacturing of high quality castings.

SUMMARY OF THE INVENTION

In Japanese Patent Application Publication No. JP-A-2002-346728, however, the heating/cooling means need be separately used, which complicates facilities. On the other hand, it is difficult to change a product shape in product design. It is therefore desired to develop a method that maintains a product shape and that is capable of preventing formation of blow holes by simple measures.

The present invention was developed in view of the above conventional problems, and is intended to provide a mold capable of preventing, by simple measures, formation of blow holes in a cast product that is molded in a product cavity, a casting method using the mold, and a design method of the mold.

According to one aspect of the present invention, a mold includes: a product cavity that is to be filled with a molten metal to mold a product; a supply cavity that connects to one side of the product cavity to supply the product cavity with the molten metal that is poured from a casting port; and a cooling cavity that connects to the other side of the product cavity and in which the molten metal filling the cooling cavity is cooled before the molten metal filling the product cavity and the supply cavity is cooled, A modulus M (=V/S) as a ratio of a volume V to a cooling surface area S in each of the cavities has a relation of Ms>Mp>Mc, where Mp is a modulus of the product cavity, Ms is a modulus of the supply cavity, and Mc is a modulus of the cooling cavity.

According to another aspect of the present invention, a casting method using the mold includes filling the supply cavity, the product cavity, and the cooling cavity with the molten metal through the casting port, and first solidifying the molten metal filling the cooling cavity, then solidifying the molten metal filling the product cavity, and lastly solidifying the molten metal filling the supply cavity.

According to still another aspect of the present invention, a design method of the mold includes dividing the product cavity into two portions, namely a product cavity portion on the one side connecting to the supply cavity, and a product cavity portion on the other side connecting to the cooling cavity, at a predetermined position of the product cavity where the product cavity has a change in shape, and determining respective shapes of the supply cavity and the cooling cavity based on the modulus Ms of the supply cavity and the modulus Mc of the cooling cavity so as to satisfy relations of "$f \times Ms/Mpa \geqq 1$" and "$f \times \{Mpa/(Mpb+Mc)\} \geqq 1$," where Mpa is a modulus of the product cavity portion on the one side, Mpb is a modulus of the product cavity portion on the other side, and f is a critical solid-phase ratio that is determined by a material component of the molten metal.

In the above mold, the supply cavity is provided on the one side of the product cavity, and the cooling cavity is provided on the other side of the product cavity. The modulus Mp of the product cavity, the modulus Ms of the supply cavity, and the modulus Mc of the cooling cavity have the relation of Ms>Mp>Mc.

Thus, when performing casting by using the above mold, the molten metal filling the cooling cavity can first be solidified, the molten metal filling the product cavity can then be solidified, and lastly the molten metal filling the supply cavity can be solidified. That is, the molten metal can be sequentially solidified from one side to the other side of the cavities by designing the respective shapes of the cavities in the mold as appropriate.

Accordingly, the above mold can prevent can prevent, by simple measures, formation of blow holes (deformation such as voids resulting from incomplete filling, cracks, or shrinkage) in a cast product that is molded in the product cavity.

Note that the cooling surface area S is the surface area of the cavity that is in contact with the molten metal in the mold.

Like the invention of the cast, the above casting method can prevent, by simple measures, formation of blow holes in a cast product that is molded in the product cavity.

The above design method of the mold provides a method for appropriately designing a mold for molding a cast product.

Specifically, the product cavity is divided into the two portions, namely the product cavity portion on the one side and the product cavity portion on the other side, and the shape of each cavity is determined so that the modulus Mpa of the product cavity portion on the one side and the modulus Mpb of the product cavity portion on the other side satisfy the relations of "$f \times Ms/Mpa \geqq 1$" and "$f \times \{Mpa/(Mpb+Mc)\} \geqq 1$."

It is considered that no blow holes are formed in a cast product that is molded in the product cavity portion on the one side if the expression "$f \times Ms/Mpa \geqq 1$" is satisfied where the modulus Mpa of the product cavity portion on the one side is a filling portion that is intensively filled with the molten metal, and the modulus Ms of the supply cavity is a supply portion that is supplied with the molten metal.

It is considered that no blow holes are formed in a cast product that is molded in the product cavity portion on the other side if the expression "$f \times \{Mpa/(Mpb+Mc)\} \geqq 1$" is satisfied where the sum of the modulus Mpb of the product cavity portion on the other side and the modulus Mc of the cooling cavity is the filling portion that is intensively filled with the molten metal, and the modulus Mpa of the product cavity portion on the one side is the supply portion that is supplied with the molten metal.

Thus, determining the respective shapes of the product cavity portion on the one side, the product cavity portion on the other side, the supply cavity, and the cooling cavity so as to satisfy the above expressions allows the mold to be manufactured which prevents formation of blow holes in a cast product that is molded in the product cavity serving as the product cavity portion on the one side and the product cavity portion on the other side.

Note that the critical solid-phase ratio f is a value represented as a ratio of a solid phase to the entire molten metal when the molten metal is in a solid-liquid coexistent state. The critical solid-phase ratio f is determined by the material component of the molten metal, and is around 0.3 in the case where the molten metal is, for example, an aluminum alloy, ADC12.

DETAILED DESCRIPTION OF THE EMBODIMENTS

Preferred embodiments of the mold and the casting method using the mold, and the design method of the mold will be described below.

The product cavity, the supply cavity, and the cooling cavity can be formed in an annular shape, the supply cavity can continuously connect in the annular shape to the product cavity on an outer peripheral side serving as the one side of the product cavity, and the cooling cavity can be formed by including a plurality of fin-shaped cavity portions, and can continuously connect in the annular shape to the product cavity on an inner peripheral side serving as the other side of the product cavity.

In this case, the supply cavity and the cooling cavity can be appropriately formed with respect to the annular product cavity, and blow holes can be prevented from being formed in an annular cast product.

It is preferable that the above mold be a die casting mold in which the product cavity, the supply cavity, and the cooling cavity are formed at a position of a mating face where a pair of mold parts are mated together.

In this case, blow holes can be prevented from being formed in a cast product serving as a die cast product.

[Embodiments]

Hereinafter, embodiments of the mold and the casting method using the mold, and the design method of the mold will be described with reference to the drawings.

(First Embodiment)

Figure 1:
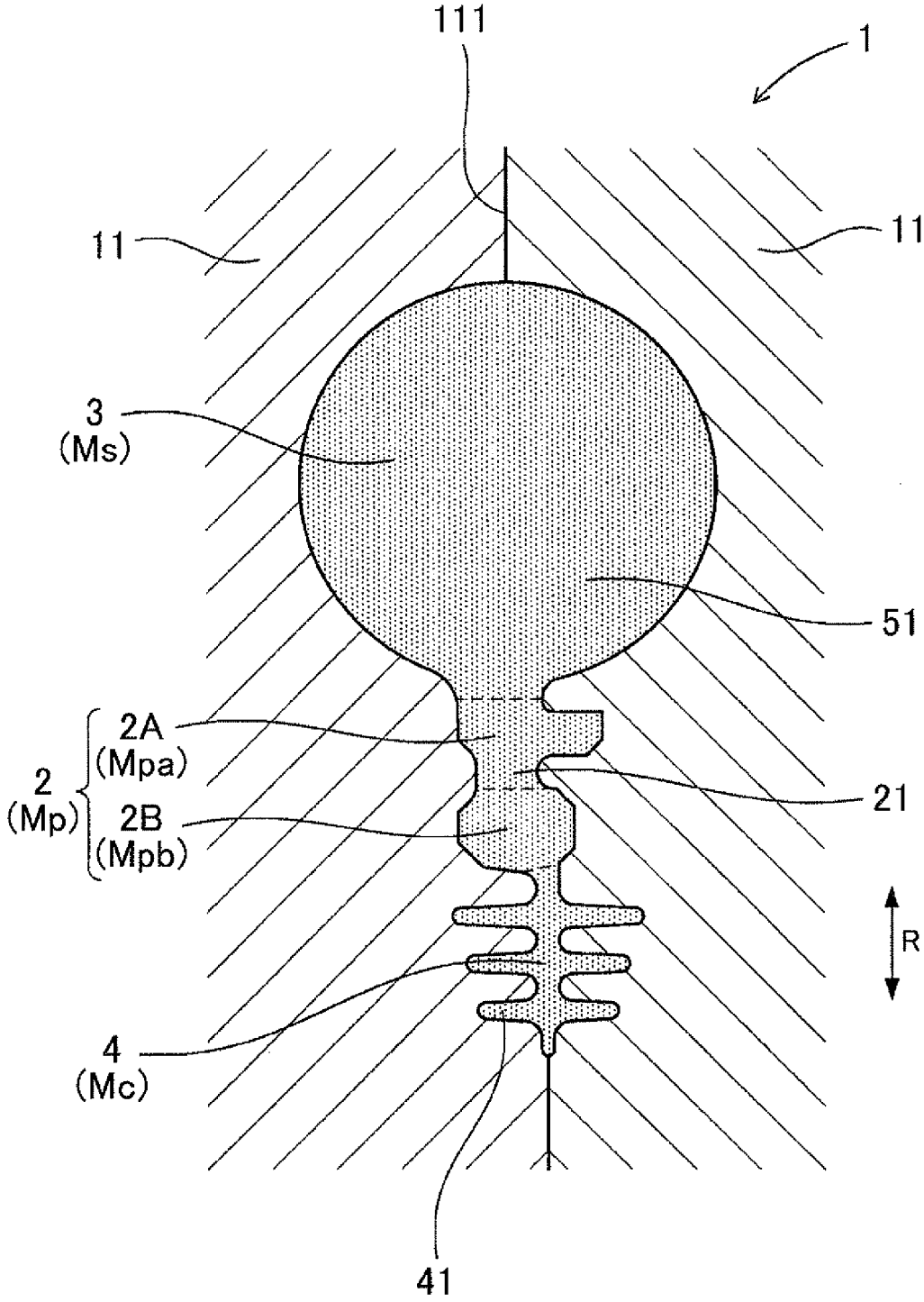
FIG. 1 is an enlarged illustration showing a part of a cross section of each cavity in a mold according to a first embodiment.
Figure 2:
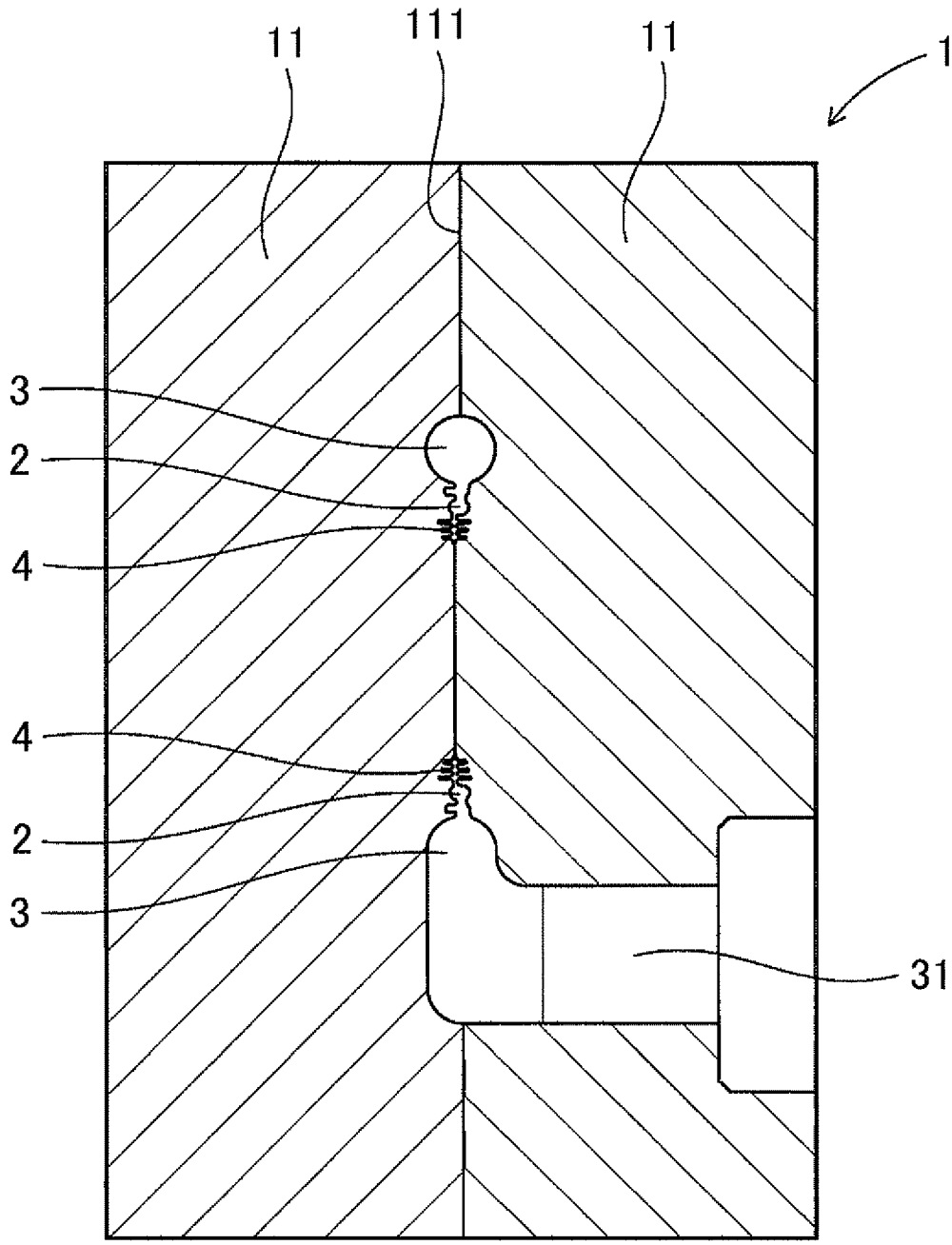
FIG. 2 is an illustration showing a cross section of the mold formed by mating a pair of mold parts according to the first embodiment.

As show in FIGS. 1 and 2, a mold 1 of the present embodiment includes: a product cavity 2 that is to be filled with a molten metal 51 to mold a product 52; a supply cavity 3 that connects to one side of the product cavity 2 to supply the product cavity 2 with the molten metal 51 that is poured from a casting port 31; and a cooling cavity 4 that connects to the other side of the product cavity 2 and in which the molten metal 51 filling the cooling cavity 4 is cooled before the molten metal 51 filling the product cavity 2 and the supply cavity 3 is cooled.

A modulus M (=V/S) as a ratio of a volume V to a cooling surface area S in each cavity 2, 3, 4 has a relation of Ms>Mp>Mc, where Mp is a modulus of the product cavity 2, Ms is a modulus of the supply cavity 3, and Mc is a modulus of the cooling cavity 4.

The mold 1 and a casting method using the mold 1, and a design method of the mold 1 according to the present embodiment will be described below with reference to FIGS. 1 to 4.

FIG. 1 is an enlarged view showing a part of a cross section of each cavity 2, 3, 4 in the mold 1. FIG. 2 is a diagram showing a cross section of the mold 1 formed by mating a pair of mold parts 11.

The mold 1 of the present embodiment molds an aluminum die cast product serving as a casting 5 in the product cavity 2 by using an aluminum material as the molten metal 51. The mold 1 of the present embodiment is a die casting mold in which the product cavity 2, the supply cavity 3, and the cooling cavity 4 are formed at the position of a mating face 111 where the pair of mold parts 11 are mated together.

The casting 5 that is molded in the mold 1 of the present embodiment is an aluminum part having an annular shape. When molding (casting) this aluminum part, the supply cavity 3 and the cooling cavity 4 are formed in the mold 1 in order to mold the product 52 in the product cavity 2 without forming blow holes.

Figure 4:
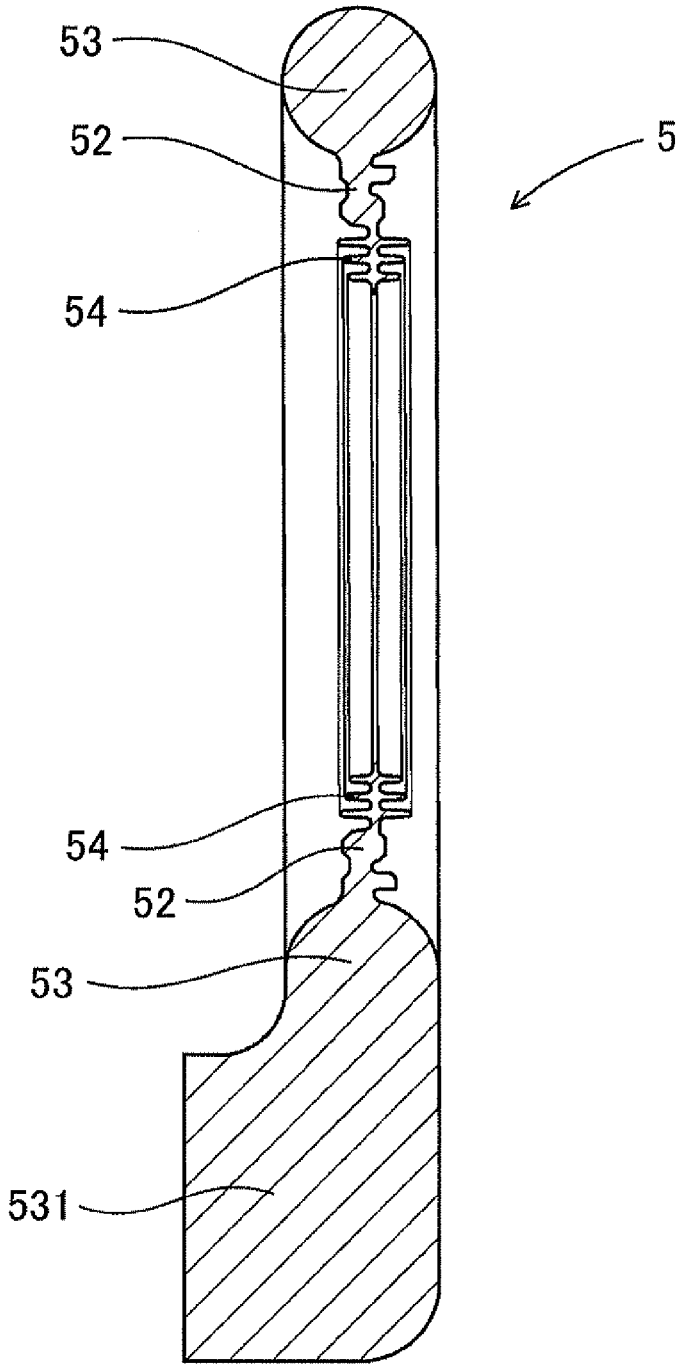
FIG. 4 is an illustration showing, in a cross section as viewed in the direction of line A-A in FIG. 3, a casting molded in the mold according to the first embodiment.

FIG. 4 shows the casting 5 molded in the mold 1. The annular product 52 is molded in the product cavity 2, a molded body 53 is molded in the supply cavity 3, a molded body 54 is molded in the cooling cavity 4, and a molded body 531 is molded in the casting port 31. Each molded body 53, 54, 531 is removed from the casting 5 after the casting process by cutting, machining, or the like, thereby forming the product 52.

Figure 3:
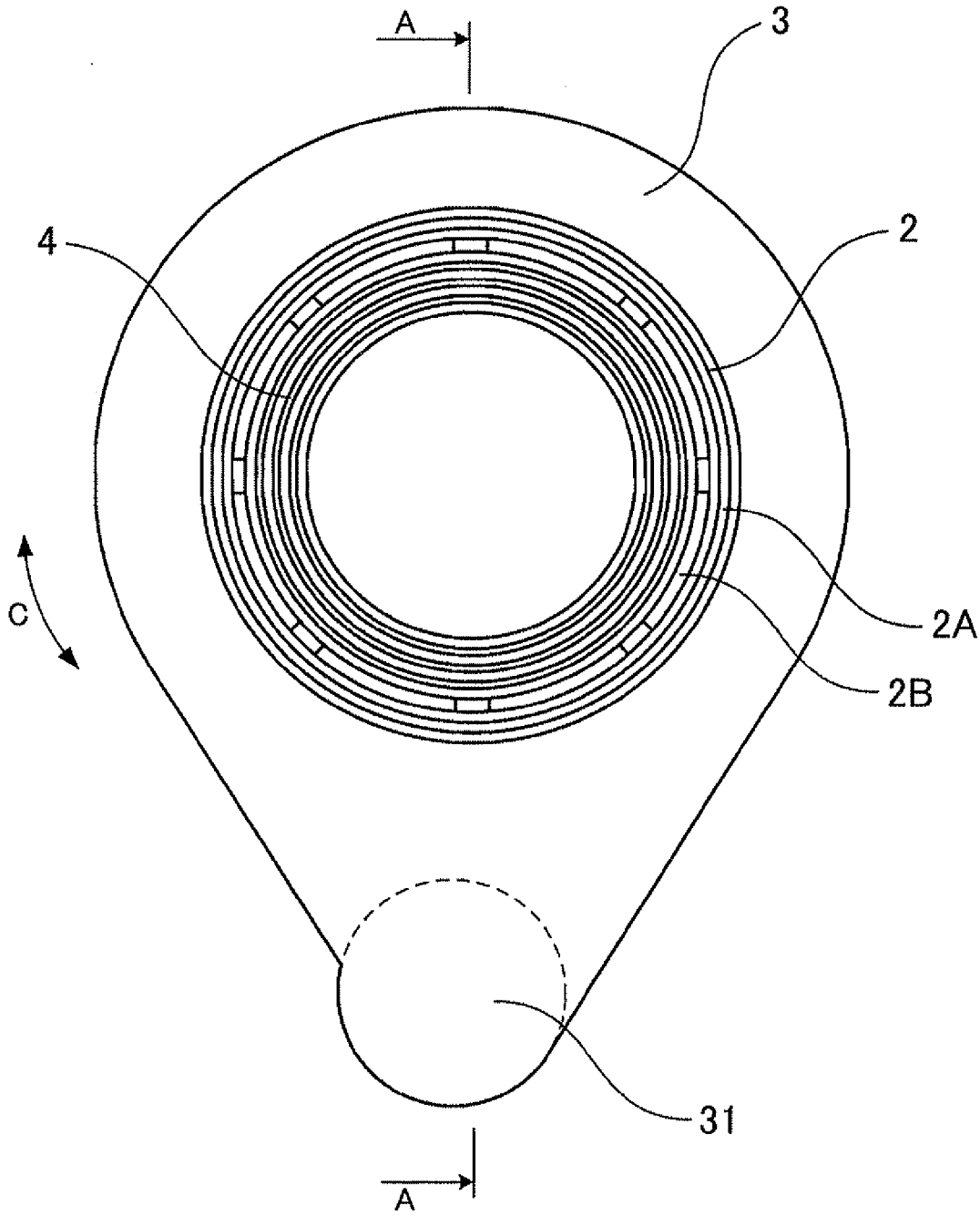
FIG. 3 is an illustration schematically showing a state in which each cavity is formed in the mold according to the first embodiment.

FIG. 3 is a diagram schematically showing a state in which each cavity 2, 3, 4 is formed in the mold 1.

As shown in the figure, in the mold 1 of the present embodiment, the annular supply cavity 3 is concentrically formed on the outer peripheral side serving as one side with respect to the annular product cavity 2, and the annular cooling cavity 4 is concentrically formed on the inner peripheral side serving as the other side with respect to the annular product cavity 2.

The supply cavity 3 continuously connects in the annular shape to the product cavity 2 on the outer peripheral side of the product cavity 2. The cooling cavity 4 is formed by including a plurality of fin-shaped cavity portions 41 (see FIG. 1), and continuously connects in the annular shape to the product cavity 2 on the inner peripheral side of the product cavity 2.

As shown in FIG. 1, the supply cavity 3 has a circular cross section in order to reduce its modulus Ms as much as possible. As shown in FIGS. 2 and 3, the casting port 31 for pouring the molten metal 51 is formed at one position in a circumferential direction of the supply cavity 3. The volume of the supply cavity 3 is larger than that of the product cavity 2.

As shown in FIG. 1, in order to increase the modulus Mc of the cooling cavity 4 as much as possible, the cooling cavity 4 is formed by arranging the plurality of fin-shaped cavity portions 41 so that the plurality of fin-shaped cavity portions 41 extend from the center position in an axial direction of the annular shape of the annular product cavity 2 toward both sides of the axial direction in a branched manner.

As shown in FIGS. 1 and 3, the product cavity 2 that molds the product 52 according to the present embodiment is formed by continuously forming a representative cross-sectional shape of the product cavity 2 in a circumferential direction C of the annular shape. The product cavity 2 has, in the representative cross-sectional shape, a recessed portion 21 serving as a change in shape at a predetermined position in a radial direction R of the annular shape which is perpendicular to the circumferential direction C of the annular shape.

As shown in FIG. 1, in a design method of the mold 1 of the present embodiment, when designing the mold 1, the product cavity 2 is divided into two portions, namely an outer peripheral portion and an inner peripheral portion, at the recessed portion 21 to determine the size and shape of the supply cavity 3 and the size and shape of the cooling cavity 4. That is, the product cavity 2 is divided at the recessed portion 21 into two portions, namely a product cavity portion 2A on the outer peripheral side serving as the one side connecting to the supply cavity 3, and a product cavity portion 2B on the inner peripheral side serving as the other side connecting to the cooling cavity 4.

In the figure, broken lines represent the boundaries of the product cavity portion 2A on the outer peripheral side, the product cavity portion 2B on the inner peripheral side, the supply cavity 3, and the cooling cavity 4.

The respective shapes of the supply cavity 3 and the cooling cavity 4 are determined based on the modulus Ms of the supply cavity 3 and the modulus Mc of the cooling cavity 4 so as to satisfy the relations of "$f \times Ms/Mpa \geqq 1$" (Expression 1) and "$f \times \{Mpa/(Mpb+Mc)\} \geqq 1$" (Expression 2), where Mpa is a modulus of the product cavity portion 2A on the outer peripheral side, Mpb is a modulus of the product cavity portion 2B on the inner peripheral side, and f is a critical solid-phase ratio that is determined by a material component of the molten metal 51.

Expressions 1 and 2 are determined based on the following reference expression that presumes formation of blow holes.

As this reference expression, a volume ratio δ(%) of blow holes is given by "$\delta = \epsilon \times \beta\{1 - f \times (M2/M1)\}$," where ϵ is an inner/outer shrinkage distribution ratio that is determined by the material component of the molten metal 51, β is a solidification shrinkage ratio that is determined by the material component of the molten metal 51, f is a critical solid-phase ratio that is determined by the material component of the molten metal 51, M1 is a filling portion that is intensively filled with the molten metal 51, and M2 is a supply portion that is supplied with the molten metal 51.

The inner/outer shrinkage distribution ratio ϵ is a value that indicates whether blow holes are more likely to be formed in an inner portion of the cavity that is filled with the molten metal 51 or in a surface portion of the cavity. The solidification shrinkage ratio β is a value that indicates a ratio of shrinkage of the molten metal 51 during solidification thereof. The critical solid-phase ratio f is a value that is represented as a ratio of a solid phase to the entire molten metal 51 when the molten metal 51 is in a solid-liquid coexistent state.

The respective sizes and shapes of the supply cavity 3 and the cooling cavity 4 are determined so as to satisfy the relation of "$f \times (M2/M1) \geqq 1$" so that the volume ratio δ of the blow holes is 0(%) or less.

The size and shape of the supply cavity 3 are determined so as to satisfy Expression 1, "$f \times Ms/Mpa \geqq 1$," where the modulus Mpa of the product cavity portion 2A on the outer peripheral side is the filling portion M1 that is intensively filled with the molten metal 51, and the modulus Ms of the supply cavity 3 is the supply portion M2 that is supplied with the molten metal 51. It is considered that if Expression 1 is satisfied, no blow holes are formed in a product that is molded in the product cavity portion 2A on the outer peripheral side.

On the other hand, the size and shape of the cooling cavity 4 are determined so as to satisfy Expression 2, "$f \times \{Mpa/(Mpb+Mc)\} \geqq 1$," where the sum of the modulus Mpb of the product cavity portion 2B on the inner peripheral side and the modulus Mc of the cooling cavity 4 is the filling portion M1 that is intensively filled with the molten metal 51, and the modulus Mpa of the product cavity portion 2A on the outer peripheral side is the supply portion M2 that is supplied with the molten metal 51. It is considered that if Expression 2 is satisfied, no blow holes are formed in a product that is molded in the product cavity portion 2B on the inner peripheral side.

Thus, determining the respective shapes of the supply cavity 3 and the cooling cavity so as to satisfy Expressions 1, 2 allows the mold 1 to be manufactured which prevents formation of blow holes in the product 52 that is molded in the product cavity 2.

A casting method using the mold 1 will be described below.

When forging the casting 5, the supply cavity 3, the product cavity 2, and the cooling cavity 4 are filled with the molten metal 51 through the casting port 31 of the mold 1. At this time, the molten metal 51 poured into the mold 1 through the casting port 31 first fills the supply cavity 3, the product cavity 2, and the cooling cavity 4 that are located closer to the casting port 31. In the present embodiment, each cavity 2, 3, 4 is instantaneously filled with the molten metal 51 in order to perform die casting.

The molten metal 51 filling the cooling cavity 4 is first solidified, and the molten metal 51 filling the product cavity portion 213 on the inner peripheral side is then solidified. Thereafter, the molten metal 51 filling the product cavity portion 2A on the outer peripheral side is solidified, and lastly the molten metal 51 filling the supply cavity 3 is solidified.

As described above, in the present embodiment, the molten metal 51 can be sequentially solidified from the inner peripheral side to the outer peripheral side of the cavities 2, 3, and 4 by designing the respective shapes of the cavities 2, 3, and 4 in the casting mold 1 as appropriate.

Accordingly, the mold 1 of the present embodiment and the casting method using the mold 1 can prevent, by simple measures, formation of blow holes (deformation such as voids resulting from incomplete filling, cracks, or shrinkage) in the product 52 that is molded in the product cavity 2.

(Second Embodiment)

The present embodiment is an example in which a product cavity 2 having a different shape from that described in the first embodiment is formed in a mold 1.

Figure 5:
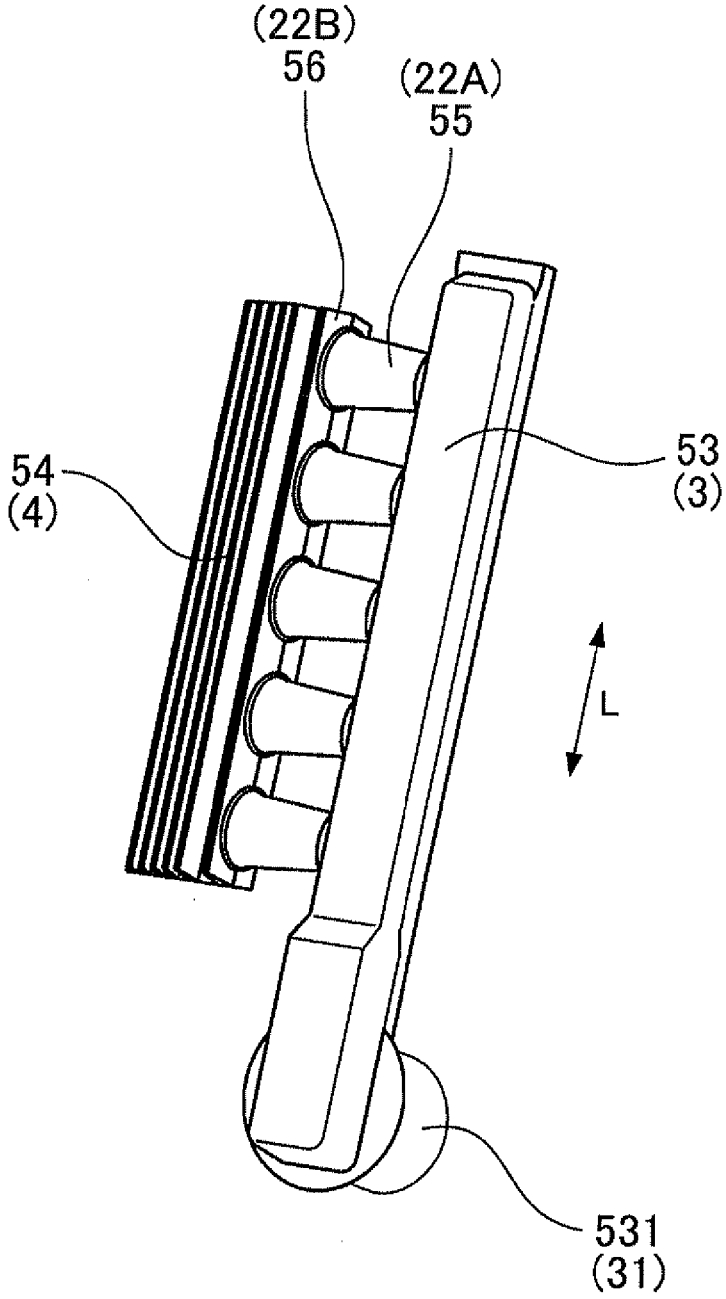
FIG. 5 is an illustration showing a casting molded in a mold according to a second embodiment.
Figure 6:
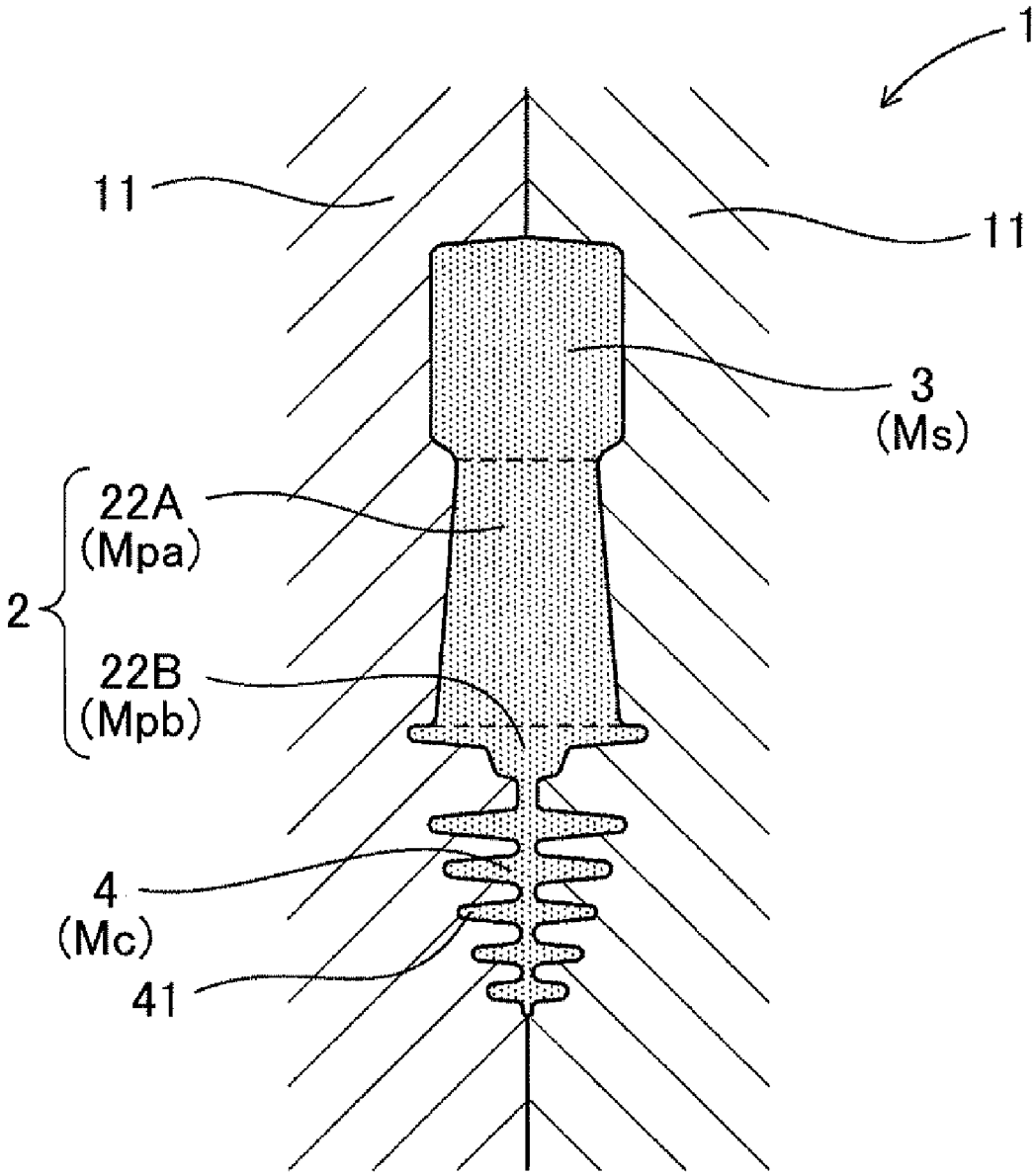
FIG. 6 is an enlarged illustration showing a part of a cross section of each cavity in the mold according to the second embodiment.

As shown in FIG. 5, a casting 5 that is molded in the mold 1 of the present embodiment is shaped so that a plurality of protruding portions 55 protrude in parallel from a base portion 56 having a long plate shape. As shown in FIG. 6, the product cavity 2 of the present embodiment is formed by a base portion cavity portion 22B that molds the base portion 56, and a protruding portion cavity portion 22A that molds the plurality of protruding portions 55.

A supply cavity 3 of the present embodiment is formed along a longitudinal direction L so as to continuously connect to a plurality of the protruding portion cavity portions 22A on one side of a direction in which the plurality of the protruding portion cavity portions 22A protrude. A cooling cavity 4 of the present embodiment formed by a plurality of fin-shaped cavity portions 41 is formed along the longitudinal direction L so as to continuously connect to the base portion cavity portion 22B in the longitudinal direction L. A casting port 31 of the present embodiment is provided at an end of the supply cavity 3.

The size and shape of the supply cavity 3 are determined so as to satisfy Expression 1, "f×Ms/Mpa≧1," where a modulus Mpa of the plurality of protruding portion cavity portions 22A is a filling portion M1 that is intensively filled with a molten metal 51, and a modulus Ms of the supply cavity 3 is a supply portion M2 that is supplied with the molten metal 51. On the other hand, the size and shape of the cooling cavity 4 are determined so as to satisfy Expression 2, "f×{Mpa/(Mpb+Mc)}≧1," where the sum of a modulus Mpb of the base portion cavity portion 2213 and a modulus Mc of the cooling cavity 4 is the filling portion M1 that is intensively filled with the molten metal 51, and the modulus Mpa of the protruding portion cavity portions 22A is the supply portion M2 that is supplied with the molten metal 51.

In the present embodiment, the supply cavity 3, the product cavity 2, and the cooling cavity 4 are filled with the molten metal 51 through the casting port 31 of the mold 1, the molten metal 51 filling the cooling cavity 4 is first solidified, and the molten metal 51 filling the base portion cavity portion 22B is then solidified. Thereafter, the molten metal 51 filling the protruding portion cavity portions 22A is solidified, and lastly the molten metal 51 filling the supply cavity 3 is solidified.

Accordingly, the mold 1 of the present embodiment and a casting method using the mold 1 can also prevent, by simple measures, formation of blow holes in the product 52 that is molded in the product cavity 2.

The configuration of the present embodiment is otherwise similar to the first embodiment, and functions and effects similar to those of the first embodiment can be obtained.

What is claimed is:

1. A mold, comprising:

a product cavity that is to be filled with a molten metal to mold a product;

a supply cavity that connects to one side of the product cavity to supply the product cavity with the molten metal that is poured from a casting port; and a cooling cavity that connects to the other side of the product cavity and in which the molten metal filling the cooling cavity is cooled before the molten metal filling the product cavity and the supply cavity is cooled, wherein a modulus M (=V/S) as a ratio of a volume V to a cooling surface area S in each of the cavities has a relation of Ms>Mp>Mc, where Mp is a modulus of the product cavity, Ms is a modulus of the supply cavity, and Mc is a modulus of the cooling cavity.

2. The mold according to claim 1, wherein the product cavity, the supply cavity, and the cooling cavity are formed in an annular shape, the supply cavity continuously connects in the annular shape to the product cavity on an outer peripheral side serving as the one side of the product cavity, and the cooling cavity is formed by including a plurality of fin-shaped cavity portions, and continuously connects in the annular shape to the product cavity on an inner peripheral side serving as the other side of the product cavity.

3. The mold according to claim 1, wherein the mold is a die casting mold in which the product cavity, the supply cavity, and the cooling cavity are folioed at a position of a mating face where a pair of mold parts are mated together.

4. The mold according to claim 2, wherein the mold is a die casting mold in which the product cavity, the supply cavity, and the cooling cavity are formed at a position of a mating face where a pair of mold parts are mated together.

5. A casting method using the mold according to claim 1, comprising filling the supply cavity, the product cavity, and the cooling cavity with the molten metal through the casting port, and first solidifying the molten metal filling the cooling cavity, then solidifying the molten metal filling the product cavity, and lastly solidifying the molten metal filling the supply cavity.

6. A casting method using the mold according to claim 2, comprising filling the supply cavity, the product cavity, and the cooling cavity with the molten metal through the casting port, and first solidifying the molten metal filling the cooling cavity, then solidifying the molten metal filling the product cavity, and lastly solidifying the molten metal filling the supply cavity.

7. A casting method using the mold according to claim 3, comprising filling the supply cavity, the product cavity, and the cooling cavity with the molten metal through the casting port, and first solidifying the molten metal filling the cooling cavity, then solidifying the molten metal filling the product cavity, and lastly solidifying the molten metal filling the supply cavity.

8. A casting method using the mold according to claim 4, comprising filling the supply cavity, the product cavity, and the cooling cavity with the molten metal through the casting port, and first solidifying the molten metal filling the cooling cavity, then solidifying the molten metal filling the product cavity, and lastly solidifying the molten metal filling the supply cavity.

* * * * *